US010531181B2

(12) United States Patent
Hagen

(10) Patent No.: US 10,531,181 B2
(45) Date of Patent: Jan. 7, 2020

(54) COMPLEMENTARY DRIVER ALIGNMENT

(71) Applicant: Harman International Industries, Incorporated, Stamford, CT (US)

(72) Inventor: Chris N. Hagen, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 0 days.

(21) Appl. No.: 15/968,563

(22) Filed: May 1, 2018

(65) Prior Publication Data

US 2018/0338202 A1 Nov. 22, 2018

Related U.S. Application Data

(60) Provisional application No. 62/507,706, filed on May 17, 2017.

(51) Int. Cl.

| | |
|---|---|
| ***H04R 1/24*** | (2006.01) |
| ***H04R 3/14*** | (2006.01) |
| ***H04R 1/28*** | (2006.01) |
| ***H04R 1/02*** | (2006.01) |

(52) U.S. Cl.

CPC ..... *H04R 1/24* (2013.01); *H04R 1/025* (2013.01); *H04R 1/2811* (2013.01); *H04R 3/14* (2013.01); *H04R 1/2834* (2013.01); *H04R 2201/028* (2013.01)

(58) Field of Classification Search

CPC ..... H04R 1/24; H04R 1/025; H04R 1/2811; H04R 1/2834; H04R 3/14; H04R 2201/028

USPC ..... 381/300, 305, 307, 28, 57–59, 85, 335, 381/120, 123, 345

See application file for complete search history.

(56) References Cited

U.S. PATENT DOCUMENTS

| | | | | |
|---|---|---|---|---|
| 3,858,679 | A * | 1/1975 | Askins | H04R 1/227 181/145 |
| 3,905,448 | A * | 9/1975 | Kawakami | H04R 7/12 181/172 |
| 4,410,064 | A * | 10/1983 | Taddeo | H04R 1/2819 181/152 |
| 5,402,502 | A * | 3/1995 | Boothroyd | H04R 1/026 181/153 |
| 6,389,139 | B1 * | 5/2002 | Curtis | H04S 3/00 381/104 |
| 8,258,872 | B1 * | 9/2012 | Lazar | H03G 3/10 330/285 |
| 9,872,116 | B2 * | 1/2018 | Qutub | H04R 29/001 |

(Continued)

*Primary Examiner* — Norman Yu
(74) *Attorney, Agent, or Firm* — McCoy Russell LLP

(57) ABSTRACT

Examples are disclosed for tuning loudspeakers to have complementary impedance characteristics. An example loudspeaker system includes an amplifier configured to generate an audio signal, and a plurality of speakers connected in parallel to the amplifier to receive the audio signal, wherein each speaker of the plurality of speakers has a unique impedance characteristic that, when combined with the impedance characteristics of the other speakers of the plurality of speakers, shows all speaker impedance characteristics to be complementary, resulting in a more level, or resistive, overall speaker system load impedance. This more level, or resistive, overall speaker system load impedance results in a more dynamic sound with more extended low end in comparison to conventional speaker systems.

15 Claims, 5 Drawing Sheets

(56) References Cited

U.S. PATENT DOCUMENTS

2012/0106766 A1* 5/2012 Kuroda ..... H04M 1/035
381/337
2014/0219480 A1* 8/2014 Collins ..... H04R 3/14
381/300

* cited by examiner

COMPLEMENTARY DRIVER ALIGNMENT

CROSS REFERENCE TO RELATED APPLICATIONS

The present application claims priority to U.S. Provisional Application No. 62/507,706 for "COMPLEMENTARY DRIVER ALIGNMENT," and filed on May 17, 2017. The entire contents of the above-listed application are hereby incorporated by reference for all purposes.

FIELD

The disclosure relates to loudspeaker systems including multiple drivers with complementary driver alignments.

BACKGROUND

An audio transducer, such as a loudspeaker, converts electrical energy into acoustical energy to generate sound. A loudspeaker includes at least one driver mounted into an enclosure. A typical driver includes a magnet and a voice coil with two leads. The voice coil may be wound cylindrically around a tube-like cylinder coupled to a diaphragm supported by a suspension. In this way, the voice coil may be configured to move back and forth substantially along an axial direction. The two leads from the voice coil may be connected to an audio amplifier that provides current through the voice coil that is a function of the electrical signal to be transformed by the driver into an audible, sub-audible, or subsonic pressure variation. As the electrical signal from the amplifier passes through the voice coil, the interaction between the current passing through the voice coil and the magnetic field produced by the magnet causes the voice coil to oscillate in accordance with the electrical signal and, in turn, drives the diaphragm and produces sound. As such, the driver converts the electrical signal source into acoustical energy to produce sound.

A loudspeaker system typically includes a driver housed in a ported enclosure or a sealed enclosure. The ported enclosure has an opening or openings to allow sound waves to push in and out of the enclosure as the diaphragm of the driver oscillates back and forth. With the sealed enclosure, however, air inside the sealed enclosure compresses and expands as the diaphragm oscillates back and forth.

SUMMARY

Typically, loudspeaker systems with multiple drivers covering the same bass range are used with the same alignment (e.g., sealed or ported) and most drivers share the same cabinet volume. In more complex systems, drivers may be partitioned such that each driver has its own enclosure. However, each enclosure is the same volume and thus the alignment and tuning is the same for each driver.

Examples are disclosed for a loudspeaker system including multiple drivers with complementary impedance characteristics. An example system comprises an amplifier configured to generate an audio signal, and a plurality of speakers connected in parallel to the amplifier to receive the audio signal, wherein a first speaker of the plurality of speakers is tuned with a first impedance characteristic and a second speaker of the plurality of speakers is tuned with a second impedance characteristic, the first impedance characteristic complementary to the second impedance characteristic.

BRIEF DESCRIPTION OF THE DRAWINGS

The disclosure may be better understood from reading the following description of non-limiting embodiments, with reference to the attached drawings, wherein below.

DETAILED DESCRIPTION

Figure 2:
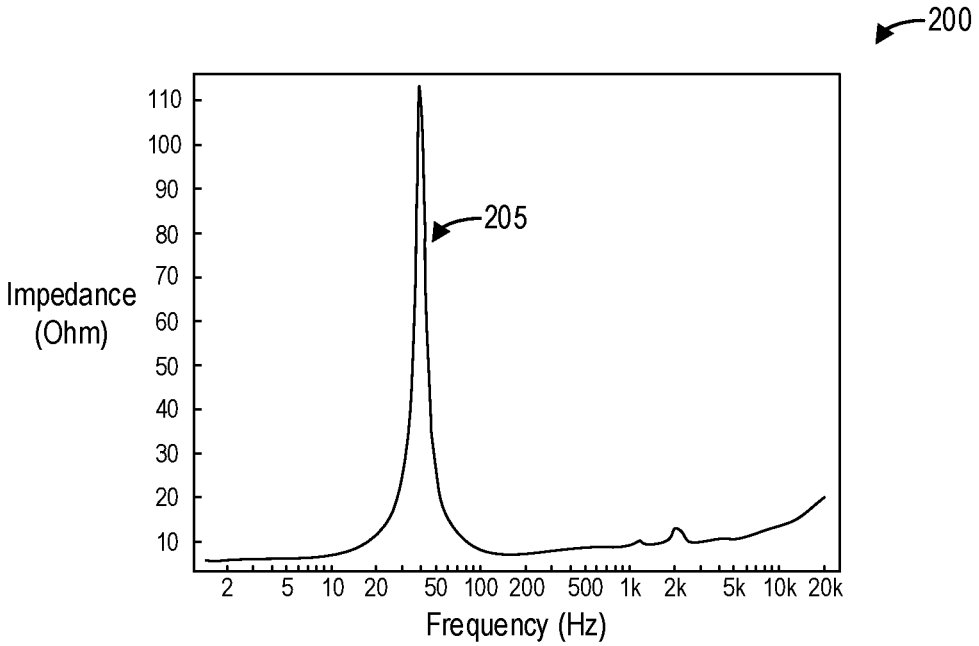
FIG. 2 shows a graph illustrating an example impedance response of a speaker in a sealed cabinet.
Figure 3:
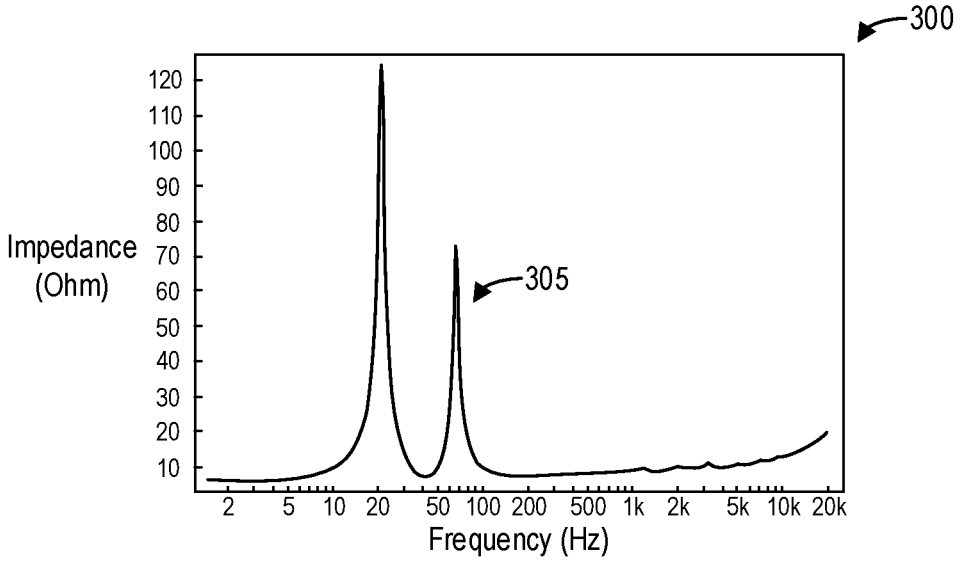
FIG. 3 shows a graph illustrating an example impedance response of a speaker in a ported cabinet.
Figure 4:
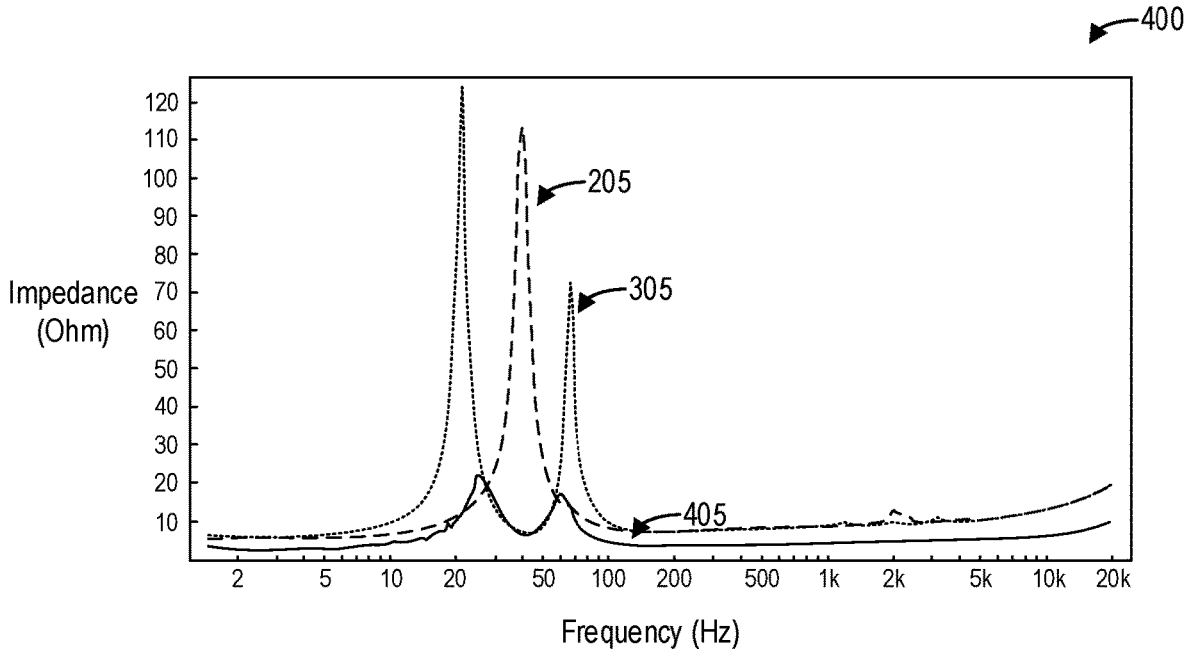
FIG. 4 shows a graph illustrating an example impedance response of a speaker system with a sealed/ported cabinet configuration.
Figure 5:
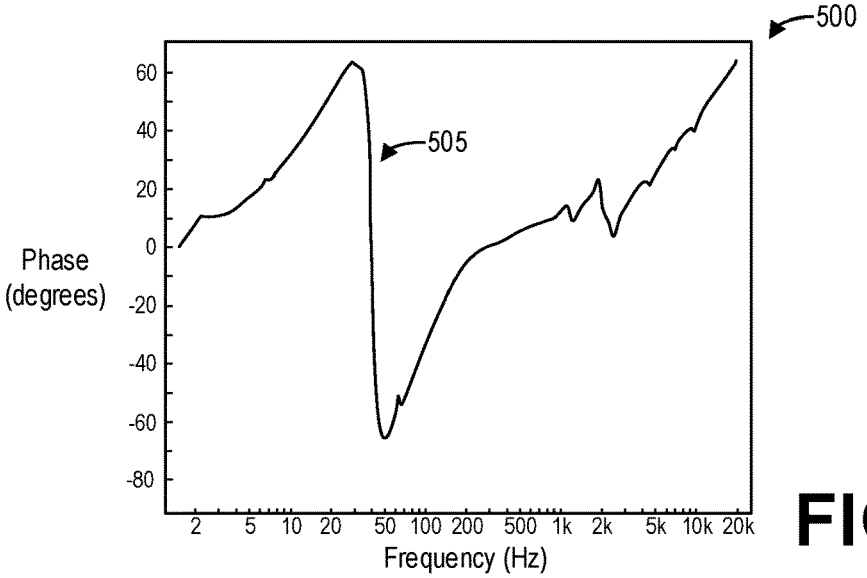
FIG. 5 shows a graph illustrating an example phase response of a speaker in a sealed cabinet.
Figure 6:
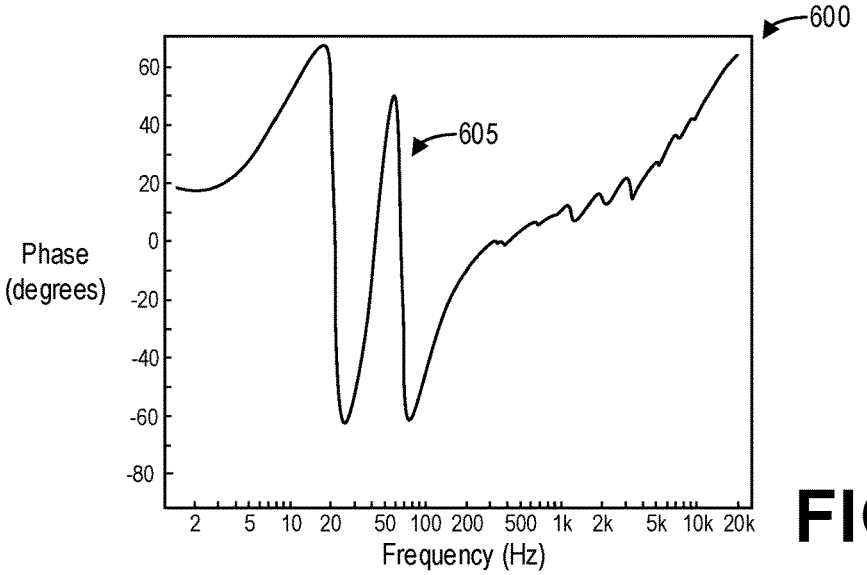
FIG. 6 shows a graph illustrating an example phase response of a speaker in a ported cabinet.
Figure 7:
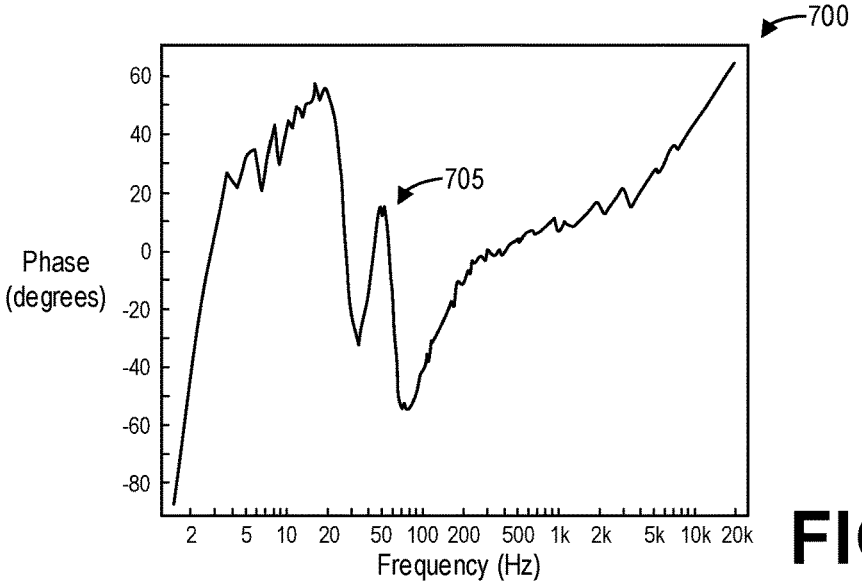
FIG. 7 shows a graph illustrating an example phase response of a speaker system with a sealed/ported cabinet configuration.
Figure 8:
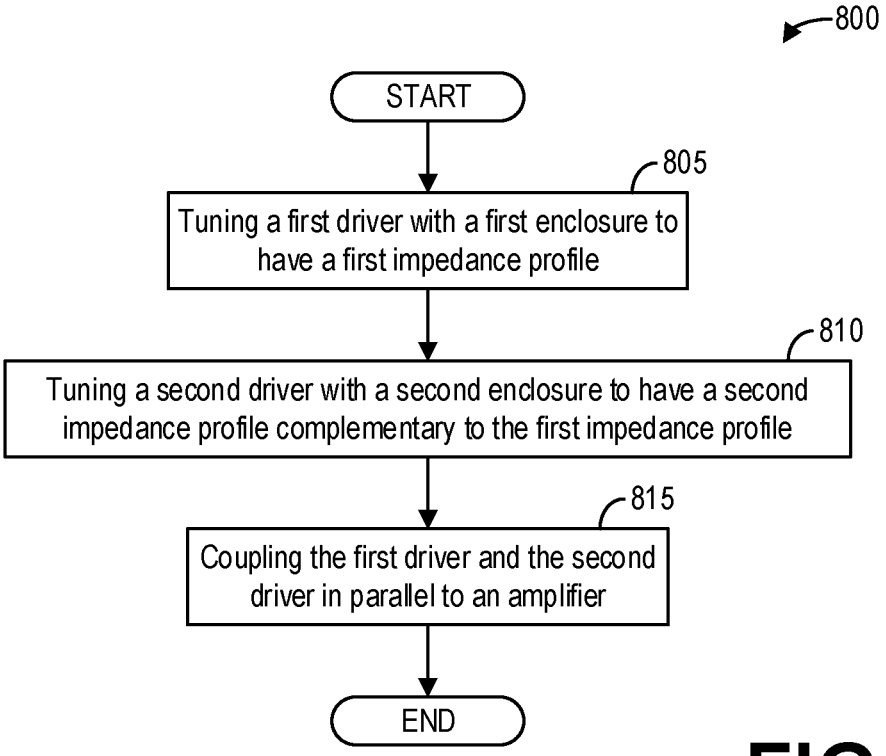
FIG. 8 shows a high-level flow chart illustrating a method for a loudspeaker system.

The following description relates to various examples of loudspeaker systems with complementary driver alignments. In particular, systems including multiple drivers with complementary impedance profiles are disclosed. For example, a loudspeaker system such as the system shown in FIG. 1 may include multiple drivers provided with dissimilar bass alignments and complementary impedance characteristics wired in parallel. One driver may be housed in a sealed enclosure so as to have a single impedance peak, as depicted in FIG. 2, while a second driver may be housed in a ported or passive-radiator-based enclosure so as to have two impedance peaks, as depicted in FIG. 3. Specifically tuning the two different enclosures so that the impedance peaks are complementary (for example, such that the one peak of the sealed enclosure is aligned with the minimum between the two peaks of the ported enclosure) and wiring the drivers in parallel provides a smoothed impedance profile overall, as depicted in FIG. 4. Further, as depicted in FIGS. 5-7, the phase profile of the system may be improved in comparison to either of the drivers alone. A method for a loudspeaker system is shown in FIG. 8.

Figure 1:
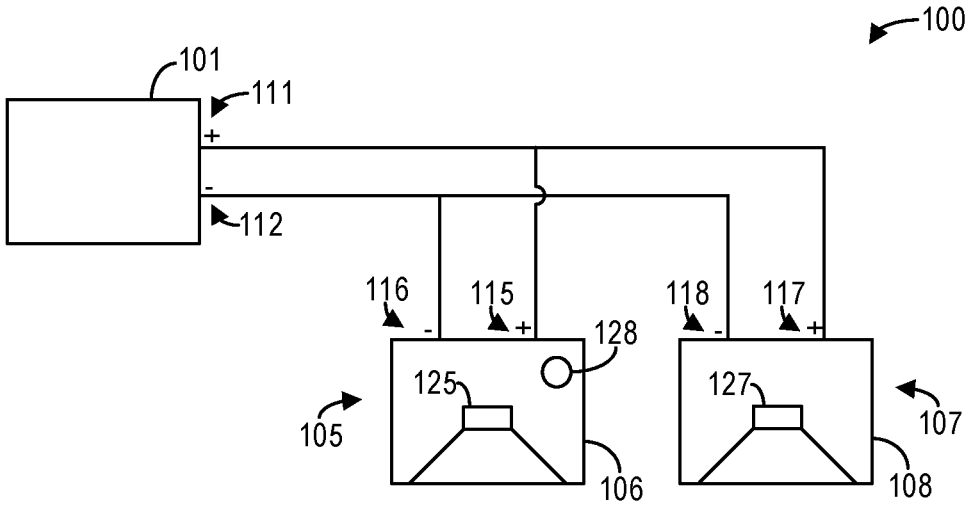
FIG. 1 shows a high-level block diagram illustrating an example speaker system.

FIG. 1 shows a high-level block diagram illustrating an example speaker system 100. The speaker system 100 includes an amplifier 101 that provides an electrical signal to a first speaker 105 and a second speaker 107. Amplifier 101 may comprise any suitable audio or electrical amplifier. It should be appreciated that while amplifier 101 is depicted as included with the speaker system 100, the amplifier 101 may be external or internal to the speaker system incorporating the art.

In some examples, the first speaker 105 and the second speaker 107 may be configured with complementary driver alignments. Additionally or alternatively, the first speaker 105 and the second speaker 107 may be tuned to have complementary impedance profiles. Due to the complementarity of the speakers' impedance responses, as described further herein, the speaker system 100 provides a more dynamic sound with an extended low end in comparison to current models of speaker systems.

First speaker 105 includes a first driver 125 enclosed within a first enclosure or cabinet 106. Similarly, second speaker 107 includes a second driver 127 enclosed within a second enclosure or cabinet 108. In some examples, first speaker 105 may include a port or a plurality of ports 128 which allow air to pass between the interior of the enclosure 106 to the exterior of the enclosure 106, and thus the first enclosure 106 may comprise a ported cabinet. In such examples, the second speaker 107 may not include a port, and thus the second enclosure 108 may comprise a sealed cabinet.

It should be appreciated that although a ported cabinet 106 and a sealed cabinet 108 are depicted in FIG. 1, in some examples both the first and second enclosures 106 and 108 may comprise sealed cabinets, ported cabinets, or other types of enclosures suitable for housing a driver. There is no requirement on driver size, type, design, or the type of alignment (open box, sealed, ported, passive radiator, transmission line, horn, etc.) to be similar.

One or more of the first speaker 105 and the second speaker 107 may include a passive radiator or plurality of passive radiators (not shown). In such examples, the passive radiator may be included in addition to an "active loudspeaker" or driver, and may be configured to be the same or similar to the active loudspeaker driver, with the exception that the passive radiator may not include or be coupled to any voice coil and/or magnet assembly. In this way, the passive radiator may not be coupled to any electrical circuit and/or power amplifier. The passive radiator is moved due to internal air pressure produced by movement of the active driver, and may be tuned by adjusting a mass of a cone of the passive radiator.

The first and second speakers 105 and 107 may include two dis-similar bass alignments with complementary impedance characteristics. For example, as mentioned above, the second speaker 107 may include a sealed enclosure 108. As an illustrative example, FIG. 2 shows a graph 200 illustrating an example impedance response 205 as a function of frequency for a sealed cabinet. Most drivers exhibit an impedance characteristic that is marked by a peak at mechanical resonance and an inductive rise, as depicted by impedance response 205. This character is true of drivers in free air or on open baffles as well as if they are mounted in a sealed cabinet 108.

Further, as mentioned above, the first speaker 105 may include a ported enclosure 106. In a ported cabinet, the single peak in impedance changes to two peaks. For example, FIG. 3 shows a graph 300 illustrating an example impedance response 305 as a function of frequency for a ported cabinet, such as ported cabinet 106. Whether a sealed or ported system has a maximally-flat character, an overdamped Bessel character, or a Chebyshev alignment only changes the frequencies and impedance levels to some extent, but not the general character. A cabinet employing a passive radiator(s) has an impedance characteristic identical to that of a ported cabinet tuned to the same frequency.

As the motor-strength of a driver increases, the increased motor-strength results in resonant peaks that are higher in magnitude. Note that the impedance responses 205 and 305, measured with a 12" JBL woofer with a nominal impedance of 8 Ohm and a BL of 17 Tm, show a variation from about 6 Ohm to a maximum of 114 Ohm and 125 Ohm, respectively, a factor of about 20:1. Other characteristics of this type of measurement are resistive characteristics that are relatively level (non-frequency dependent), inductive characteristics that rise in impedance with frequency, or capacitive characteristics that fall in impedance with rising frequency.

Referring again to FIG. 1, the amplifier 101 is wired in parallel to the first speaker 105 and the second speaker 107, as depicted. In particular, the positive terminal 111 of the amplifier 101 is wired in parallel to the positive terminal 115 of the first speaker 105 and the positive terminal 117 of the second speaker 107. Similarly, the negative terminal 112 of the amplifier 101 is wired in parallel to the negative terminal 116 of the first speaker and the negative terminal 118 of the second speaker 107. As discussed further herein, wiring the first and second speakers 105 and 107 in parallel to the amplifier 101 enables the current provided by the amplifier 101 to be steered to at least one of the speakers 105 and 107 depending on the impedance of the speakers at the frequency of the signal being applied by the amplifier.

Wiring the first speaker 105 and the second speaker 107 as described above evens out the impedance variation. As an illustrative example, FIG. 4 shows a graph 400 illustrating an example impedance response 405 as a function of frequency for a combination sealed-ported speaker system, such as the speaker system 100 depicted in FIG. 1. Graph 400 also illustrates the individual impedance responses 205 and 305 of the second and first speakers 107 and 105 respectively for comparison. As depicted, the impedance peak of the impedance response 205 is aligned with the local minimum between the two impedance peaks of the impedance response 305. As a result, the impedance response 405 of the overall loudspeaker system is reduced and thus improved relative to the impedance response 205 or 305 of the individual speakers.

The impedance response 405 of the combination sealed-ported speaker system 100 illustrates how the impedance variation is approximately 4 Ohm to 24 Ohm, or 6:1. Thus, the impedance variation of the speaker system 100 is substantially lower than the impedance variation of a speaker system that includes only ported or sealed speakers with a similar impedance response.

Furthermore, with the parallel wiring, in addition to diminishing the impedance variation, the amplifier energy is naturally steered by the differing impedance, as a function of frequency, between the cabinets. With proper tuning and configuration, a cabinet that is weak in power handling at an impedance peak may naturally reduce current to its driver due to the high impedance, while the cabinet that may be more resilient to the power at that frequency may have a low impedance and naturally take on the main portion of the amplifier current.

In the case of two speakers with similar enclosures or similar impedance responses, one speaker or both speakers may be tuned such that any substantial impedance peaks are offset from each other. In this way, if one speaker exhibits a high impedance at a given frequency, the other speaker exhibits a low impedance, and the combined speaker system wired in parallel offers the improved acoustic and electronic performance described herein.

Further still, the electrical phase of the speaker system 100 is also smoothed. To illustrate, FIG. 5 shows a graph 500 illustrating an example phase response 505 as a function of frequency for a sealed cabinet while FIG. 6 shows a graph 600 illustrating an example phase response 605 as a function of frequency for a ported cabinet. Both the phase response 505 and the phase response 605 depict phase swings from +65 degrees to −65 degrees.

In contrast, FIG. 7 shows a graph 700 illustrating an example phase response 705 as a function of frequency for a combination sealed-ported speaker system such as speaker system 100. Instead of +/−65 degree swing of the separate cabinets, the phase swing is now +/−55 degrees. The lesser phase swing corresponds to an easier load for an amplifier. Acoustically, the configuration provides a more dynamic sound with more extended low end in comparison to conventional speaker systems without complementary impedance alignments.

A frequency response of a loudspeaker may be defined, at least in part, by three parameters: compliance or Vas, Free-air resonance (Fs), and total speaker Q (Qts). Compliance (Vas) is a measure of the overall stiffness, or resistance to motion of structural elements of the loudspeaker such as a cone, a surround, and a spider or other suspension element. The compliance may be specified in terms of the volume of air having the same compliance as the driver of the loudspeaker.

Free-air resonance (Fs) is the resonant frequency of the driver's voice coil impedance with the driver suspended in free air (e.g., no enclosure). The −3 dB frequency of an enclosure is proportional to Fs. Total speaker Q (Qts) is a measure of the sharpness of the driver's free-air impedance resonance. Total speaker Q is defined as (Fh−Fl)/Fs, where Fh and Fl are the upper and lower (respectively) −3 dB points of the driver's voice coil impedance in free air (e.g., Fh is the −3 dB frequency for high-end roll off, and Fl is the −3 dB frequency for low-end roll off). A ported enclosure may have an optimum tuning frequency Fb which is the resonant frequency of the duct of the ported enclosure. The tuning frequency is determined by the cross-sectional area, length of the duct, and the effective air volume of the cabinet.

Systems with other types of alignments may be configured such that the highest peak of one cabinet's impedance aligns with an impedance minimum of the other cabinet. Using two ported cabinets, for example, a system may be configured to set the minimum between impedance peaks (Fb) of one cabinet to be equal to one of the impedance peaks on either side of the impedance minimum (Fb) of the other cabinet (Fl or Fh—these are not the same Fl and Fh for calculating total speaker Q, but named the same by convention). Tuning the drivers and cabinets in this way makes the impedance response of the speakers complementary to each other.

To illustrate a general method for loudspeaker systems with complementary drivers, FIG. 8 shows a high-level flow chart illustrating an example method 800 for a loudspeaker system. In particular, method 800 relates to tuning multiple drivers to have complementary impedance profiles or characteristics.

Method 800 begins at 805. At 805, method 800 includes tuning a first driver with a first enclosure to have a first impedance profile. The first driver may comprise a primary driver configured for converting an audio signal to a corresponding sound. The first enclosure may comprise a ported enclosure, a sealed enclosure, a vented enclosure, or another suitable enclosure for a loudspeaker.

At 810, method 800 includes tuning a second driver with a second enclosure to have a second impedance profile complementary to the first impedance profile. Tuning the second driver with the second enclosure to have a second impedance profile complementary to the first impedance profile comprises tuning the second driver such that the second impedance profile includes at least one impedance characteristic that is complementary to at least one impedance characteristic of the first impedance profile. For example, the second driver may be tuned such that a local minimum of the second impedance profile is aligned or occurs at a same frequency as a local maximum of the first impedance profile. As an illustrative example, as discussed hereinabove with regard to FIG. 4, the impedance peak of the impedance response 205 is configured to align with the local minimum between the two impedance peaks of the impedance response 305, thereby resulting (when the speakers are wired in parallel) in an impedance response 405 with impedance peaks that are substantially smaller than the impedance peaks of the impedance responses 205 or 305.

To that end, the type of enclosure of the second enclosure may be selected to achieve the impedance characteristic(s) of the second impedance profile. For example, the second enclosure may comprise a ported enclosure, a sealed enclosure, a vented enclosure, or another suitable enclosure for a loudspeaker. In some examples, the particular type of enclosure for the second enclosure may be selected based on the first enclosure. As one illustrative example, if the first enclosure comprises a ported enclosure, the second enclosure may comprise a sealed enclosure. In such an example, the first (or second) enclosure may be selected to be a different type of enclosure than the second (or first) enclosure.

It should be appreciated that in some examples, the second enclosure may comprise the first enclosure. That is, the first driver and the second driver may be housed within a single enclosure. In such examples, the first driver and the second driver may be partitioned into separate volumes of the shared enclosure.

In addition to or as an alternative to selecting one or more types of enclosures for the speakers, the drivers of each speaker as well as additional electronic components for each speaker may be configured to provide the desired complementary impedance response. More specifically, the drivers and electronic components may be configured such that substantial impedance characteristics, such as impedance peaks, are at least offset from each other such that the two loudspeakers, when wired in parallel, do not exhibit high impedance responses at a same frequency.

At 815, method 800 includes coupling the first driver and the second driver in parallel to an amplifier. Power delivered to the first driver and the second driver is dynamically allocated to the drivers based on the impedance profile of the drivers, and the due to the parallel wiring of the drivers to the amplifier and the complementarity of the impedance profiles, the overall impedance profile of the loudspeaker system is improved with respect to the impedance profile of either driver as discussed hereinabove. Method 800 then ends.

The disclosure provides for loudspeaker systems that are tuned so that the impedance delivered to an amplifier of the system is more resistive (than in other loudspeaker systems), thereby reducing variation from minimum impedance to maximum impedance (relative to other loudspeaker systems). A technical effect of the disclosed loudspeaker systems and methods is that the lower phase swing (e.g., reduced variation from minimum to maximum impedance) provides an easier load for an amplifier than other configurations, providing more dynamic sounds with more extended low ends (low frequency sound reproduction capabilities) relative to other configurations.

In one embodiment, a loudspeaker system comprises an amplifier configured to generate an audio signal, and a plurality of speakers connected in parallel to the amplifier to receive the audio signal, wherein a first speaker of the plurality of speakers is tuned with a first impedance characteristic and a second speaker of the plurality of speakers is tuned with a second impedance characteristic, the first impedance characteristic complementary to the second impedance characteristic.

In a first example of the loudspeaker system, the first speaker comprises a first driver and the second speaker comprises a second driver. In a second example of the loudspeaker system optionally including the first example, the first driver is housed within a first enclosure and the second driver is housed within a second enclosure. In a third example of the loudspeaker system optionally including one or more of the first and second examples, the first enclosure comprises one of a first sealed enclosure, a first ported enclosure, or a first vented enclosure, and wherein the second enclosure comprises one of a second sealed enclosure, a second ported enclosure, or a second vented enclosure. In a fourth example of the loudspeaker system optionally including one or more of the first through third examples, the first enclosure comprises a sealed enclosure and the second enclosure comprises a ported enclosure. In a fifth example of the loudspeaker system optionally including one or more of the first through fourth examples, the first impedance characteristic comprises a first frequency-dependent impedance response and the second impedance characteristic comprises a second frequency-dependent impedance response, wherein a local maximum of the first frequency-dependent impedance response is aligned with a local minimum of the second frequency-dependent impedance response.

In another embodiment, a method for a loudspeaker system comprises tuning a first speaker with a first impedance profile, and tuning a second speaker with a second impedance profile complementary to the first impedance profile, wherein the first speaker and the second speaker are coupled in parallel to an amplifier.

In a first example of the method, tuning the first speaker with the first impedance profile comprises configuring the first speaker with an impedance maximum at a given frequency. In a second example of the method optionally including the first example, tuning the second speaker with the second impedance profile complementary to the first impedance profile comprises configuring the second speaker with an impedance minimum at the given frequency. In a third example of the method optionally including one or more of the first through second examples, the first speaker is enclosed in a first ported cabinet and the second speaker is enclosed in a second ported cabinet, and a duct(s) of the first ported cabinet is sized to produce a resonant frequency that is equal to a lower or an upper impedance peak for the second ported cabinet. In a fourth example of the method optionally including one or more of the first through third examples, the method further comprises providing, with the amplifier, an audio signal to the first speaker and the second speaker.

In yet another embodiment, a loudspeaker system comprises a first speaker housed in a first enclosure and tuned with a first impedance characteristic, and a second speaker housed in a second enclosure and tuned with a second impedance characteristic complementary to the first impedance characteristic, wherein the first speaker and the second speaker are coupled in parallel to an audio amplifier.

In a first example of the loudspeaker system, the first enclosure comprises one of a first free-air driver, a first sealed enclosure, a first ported or vented enclosure, a first passive radiator enclosure, a first transmission line, or a first horn alignment and wherein the second enclosure comprises one of a second free-air driver, a second sealed enclosure, a second ported or vented enclosure, a second passive radiator enclosure, a second transmission line, or a second horn alignment. In a second example of the loudspeaker system optionally including the first example, the impedance characteristics of drivers of the first speaker and the second speaker comprise a plurality of frequency-dependent impedance responses and are aligned in complementary fashion, wherein local maxima of one or more frequency-dependent impedance responses are aligned with one or more local minima of one or more frequency-dependent impedance responses. In a third example of the loudspeaker system optionally including one or more of the first and second examples, the first impedance characteristic comprises a first frequency-dependent impedance response and the second impedance characteristic comprises a second frequency-dependent impedance response, wherein a local maximum of the first frequency-dependent impedance response is aligned with a local minimum of the second frequency-dependent impedance response. In a fourth example of the loudspeaker system optionally including one or more of the first through third examples, the first enclosure comprises a first ported cabinet and the second enclosure comprises a second ported cabinet, wherein a duct of the first ported cabinet is sized to produce a resonant frequency that is equal to a lower or an upper resonant impedance peak of the impedance for the second ported cabinet. In a fifth example of the loudspeaker system optionally including one or more of the first through fourth examples, the first speaker tuned with the first impedance characteristic comprises the first speaker configured with an impedance maximum at a given frequency. In a sixth example of the loudspeaker system optionally including one or more of the first through fifth examples, the second speaker tuned with the second impedance characteristic complementary to the first impedance characteristic comprises the second speaker configured with an impedance minimum at the given frequency.

The description of embodiments has been presented for purposes of illustration and description. Suitable modifications and variations to the embodiments may be performed in light of the above description or may be acquired from practicing the methods. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A loudspeaker system, comprising:

an amplifier configured to generate an audio signal; and a plurality of speakers connected in parallel to the amplifier to receive the audio signal;

wherein a first speaker of the plurality of speakers includes a first driver housed in a first enclosure and is tuned with a first impedance characteristic and a second speaker of the plurality of speakers includes a second driver housed in a second enclosure and is tuned with a second impedance characteristic;

wherein the first impedance characteristic is complementary to the second impedance characteristic, the first impedance characteristic comprises a first frequency-dependent impedance response, the second impedance characteristic comprises a second frequency-dependent impedance response, and a local maximum of the first frequency-dependent impedance response is aligned with a local minimum of the second frequency-dependent impedance response; and wherein the first frequency-dependent impedance response includes a parameter associated with the first driver and a parameter associated with the first enclosure and the second frequency-dependent impedance response includes a parameter associated with the second driver and a parameter associated with the second enclosure.

2. The loudspeaker system of claim 1, wherein the plurality of speakers is employed such that the impedance characteristic of each speaker enhances the complementarity of an impedance characteristic of the loudspeaker system as a whole.

3. The loudspeaker system of claim 1, wherein the first enclosure comprises one of a first free-air driver, a first sealed enclosure, a first ported enclosure, a first vented enclosure, a first passive radiator enclosure, a first transmission line, or a first horn alignment and wherein the second enclosure comprises one of a second free-air driver, a second sealed enclosure, a second ported enclosure, a second vented enclosure, a second passive radiator enclosure, a second transmission line, or a second horn alignment.

4. The loudspeaker system of claim 3, wherein the first enclosure comprises the first sealed enclosure and the second enclosure comprises the second ported enclosure.

5. A method, comprising:

tuning a first speaker including a first driver included in a first enclosure with a first frequency-dependent impedance response; and tuning a second speaker including a first driver included in a first enclosure with a second frequency-dependent impedance response complementary to the first frequency-dependent impedance response by aligning a highest peak of the first frequency-dependent impedance response with an impedance minimum of the second frequency-dependent impedance response, wherein the first speaker and the second speaker are coupled in parallel to an amplifier;

wherein the first frequency-dependent impedance response includes a parameter associated with the first driver and a parameter associated with the first enclosure and the second frequency-dependent impedance response includes a parameter associated with the second driver and a parameter associated with the second enclosure.

6. The method of claim 5, wherein tuning the first speaker with the first frequency-dependent impedance response comprises configuring the first speaker with the highest peak at a given frequency.

7. The method of claim 6, wherein tuning the second speaker with the second frequency-dependent impedance response complementary to the first frequency-dependent impedance response comprises configuring the second speaker with the impedance minimum at the given frequency.

8. The method of claim 5, wherein the first enclosure is a first ported cabinet and the second enclosure is a second ported cabinet, and wherein a duct of the first ported cabinet is sized to produce a resonant frequency that is equal to a lower resonant impedance peak corresponding to the impedance minimum of the second ported cabinet or an upper resonant impedance peak corresponding to an impedance maximum of the second ported cabinet.

9. The method of claim 5, further comprising providing, with the amplifier, an audio signal to the first speaker and the second speaker.

10. A loudspeaker system, comprising:

a first speaker including a first driver housed in a first enclosure and tuned with a first impedance characteristic; and a second speaker including a second driver housed in a second enclosure and tuned with a second impedance characteristic complementary to the first impedance characteristic;

wherein a highest peak of a cabinet impedance of the first speaker is frequency-aligned with an impedance minimum of the second speaker;

wherein the first driver and the second driver are coupled in parallel to an audio amplifier; and wherein the first impedance characteristic includes a parameter associated with the first driver and a parameter associated with the first enclosure and the second impedance characteristic includes a parameter associated with the second driver and a parameter associated with the second enclosure.

11. The loudspeaker system of claim 10, wherein the first enclosure comprises one of a first sealed enclosure, a first ported enclosure, a first vented enclosure, a first passive radiator enclosure, a first transmission line, and a first horn alignment and wherein the second enclosure comprises a second sealed enclosure, a second ported enclosure, a second vented enclosure, a second passive radiator enclosure, a second transmission line, and a second horn alignment.

12. The loudspeaker system of claim 10, wherein the first impedance characteristic comprises a first frequency-dependent impedance response and the second impedance characteristic comprises a second frequency-dependent impedance response, wherein a local maximum of the first frequency-dependent impedance response is aligned with a local minimum of the second frequency-dependent impedance response.

13. The loudspeaker system of claim 10, wherein the first enclosure comprises a first ported cabinet and the second enclosure comprises a second ported cabinet, and wherein a duct of the first ported cabinet is sized to produce a resonant frequency that is equal to a lower or an upper resonant impedance peak of the impedance of the second ported cabinet.

14. The loudspeaker system of claim 10, wherein the first speaker tuned with the first impedance characteristic comprises the first speaker configured with an impedance maximum at a given frequency.

15. The loudspeaker system of claim 14, wherein the second speaker tuned with the second impedance characteristic complementary to the first impedance characteristic comprises the second speaker configured with an impedance minimum at the given frequency, and wherein the given frequency is set by a cross-sectional area of each of the first enclosure and the second enclosure, a length of a duct of each of the first enclosure and the second enclosure, and an effective air volume of each of the first enclosure and the second enclosure.

* * * * *